US012201162B2

(12) United States Patent
Kim et al.

(10) Patent No.: US 12,201,162 B2
(45) Date of Patent: Jan. 21, 2025

(54) AEROSOL-GENERATING ARTICLE INCLUDING VAPORIZING SUBSTRATE AND AEROSOL-GENERATING SYSTEM USING THE SAME

(71) Applicant: KT&G CORPORATION, Daejeon (KR)

(72) Inventors: Jeong Hoo Kim, Cheongju-si (KR); Woo Seok Chung, Namyangju-si (KR)

(73) Assignee: KT&G CORPORATION, Daejeon (KR)

( * ) Notice: Subject to any disclaimer, the term of this patent is extended or adjusted under 35 U.S.C. 154(b) by 734 days.

(21) Appl. No.: 17/421,799

(22) PCT Filed: Oct. 13, 2020

(86) PCT No.: PCT/KR2020/013925
§ 371 (c)(1),
(2) Date: Jul. 9, 2021

(87) PCT Pub. No.: WO2021/075821
PCT Pub. Date: Apr. 22, 2021

(65) Prior Publication Data

US 2022/0087326 A1 Mar. 24, 2022

(30) Foreign Application Priority Data

Oct. 14, 2019 (KR) ..... 10-2019-0127271

(51) Int. Cl.
*A24F 42/10* (2020.01)
*A24B 15/28* (2006.01)
*A24D 1/20* (2020.01)

(52) U.S. Cl.
CPC ..... *A24F 42/10* (2020.01); *A24B 15/281* (2013.01); *A24B 15/287* (2013.01); *A24D 1/20* (2020.01)

(58) Field of Classification Search
CPC ..... A24F 42/10
See application file for complete search history.

(56) References Cited

U.S. PATENT DOCUMENTS

| | | | |
|---|---|---|---|
| 3,258,015 | A | 6/1966 | Ellis et al. |
| 4,694,841 | A | 9/1987 | Esparza |
| 11,033,053 | B2 | 6/2021 | Courbat et al. |
| 2014/0196736 | A1 | 7/2014 | Fernando et al. |

(Continued)

FOREIGN PATENT DOCUMENTS

| | | | |
|---|---|---|---|
| CN | 105011370 | A | 11/2015 |
| CN | 105747280 | A | 7/2016 |

(Continued)

OTHER PUBLICATIONS

Translation of DE-19854008 (Year: 2000).*

(Continued)

*Primary Examiner* — Cynthia Szewczyk
(74) *Attorney, Agent, or Firm* — Sughrue Mion, PLLC

(57) ABSTRACT

An aerosol-generating article includes a sealed container; and a composition contained in the sealed container and including a tobacco material and a vaporizing agent, wherein the tobacco material includes an aerosol-generating material and tobacco leaves, and the vaporizing agent generates oxidizing heat when exposed to air such that an aerosol may be generated without a heating device or electric power.

9 Claims, 3 Drawing Sheets

(56) References Cited

U.S. PATENT DOCUMENTS

| | | | |
|---|---|---|---|
| 2015/0237913 | A1 | 8/2015 | Suzuki et al. |
| 2015/0335062 | A1 | 11/2015 | Shinkawa et al. |
| 2017/0095002 | A1 | 4/2017 | Silvestrini |
| 2018/0271152 | A1 | 9/2018 | Silvestrini et al. |
| 2018/0360099 | A1 | 12/2018 | Ibrahim |
| 2019/0174813 | A1 | 6/2019 | Benjak et al. |
| 2019/0289901 | A1 | 9/2019 | Sutton |

FOREIGN PATENT DOCUMENTS

| | | | | |
|---|---|---|---|---|
| CN | 205993630 | U | 3/2017 | |
| DE | 19854008 | A1 * | 5/2000 | ..... A24F 42/10 |
| JP | 2-138597 | U | 11/1990 | |
| JP | 5-507639 | A | 11/1993 | |
| JP | 2006-234315 | A | 9/2006 | |
| KR | 10-2017-0135043 | A | 12/2017 | |
| KR | 10-2019-0029702 | A | 3/2019 | |
| KR | 10-2019-0058657 | A | 5/2019 | |
| WO | 2014/045024 | A2 | 3/2014 | |
| WO | 2014/061477 | A1 | 4/2014 | |
| WO | 2015/063485 | A1 | 5/2015 | |
| WO | 2018019578 | A1 | 2/2018 | |
| WO | 2019/105811 | A1 | 6/2019 | |

OTHER PUBLICATIONS

Office Action dated Sep. 27, 2022, issued in Japanese Application No. 2021-547275.

Notification of Reasons for Refusal dated Feb. 21, 2023 from the Japanese Patent Office in application No. 2021-547275.

Communication dated Sep. 28, 2023 issued by the Intellectual Property Office of the P.R.China in application No. 202080011377.0.

Extended European Search Report issued Mar. 1, 2022 in European Application No. 20875737.7.

Korea Intellectual Property Office Notification of Reason for Refusal for KR 10-2019-0127271 dated Dec. 4, 2020.

Korea Intellectual Property Office Grant of Patent for KR 10-2019-0127271 dated Jun. 11, 2021.

International Search Report for PCT/KR2020/013925 dated Jan. 19, 2021.

Written Opinion for PCT/KR2020/013925 dated Jan. 19, 2021.

Office Action issued Jan. 3, 2024 in Chinese Application No. 202080011377.0.

* cited by examiner

[Fig. 1]
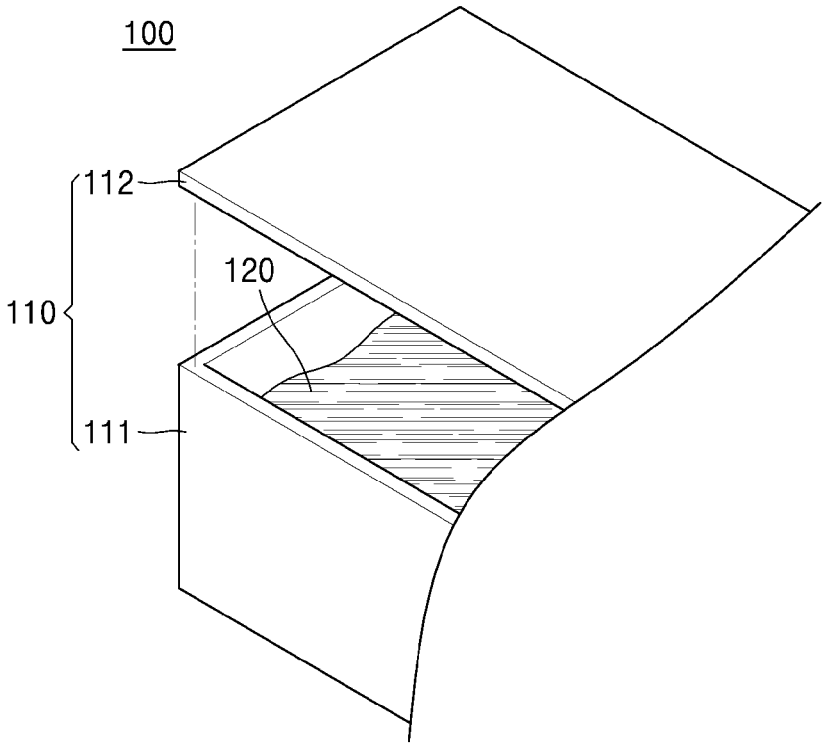
[Fig. 2]
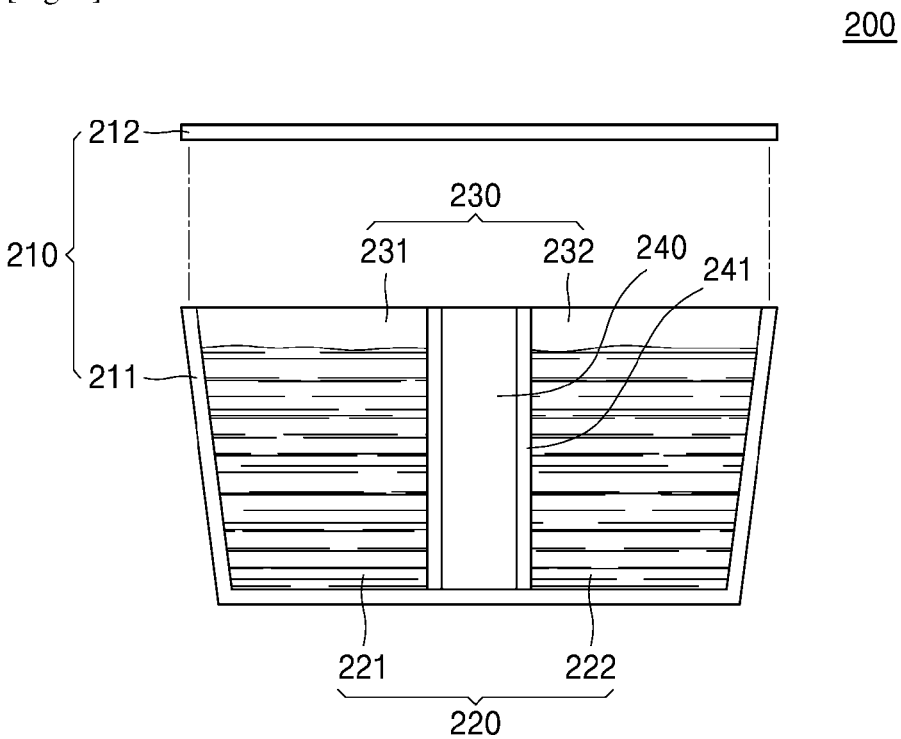

[Fig. 3]
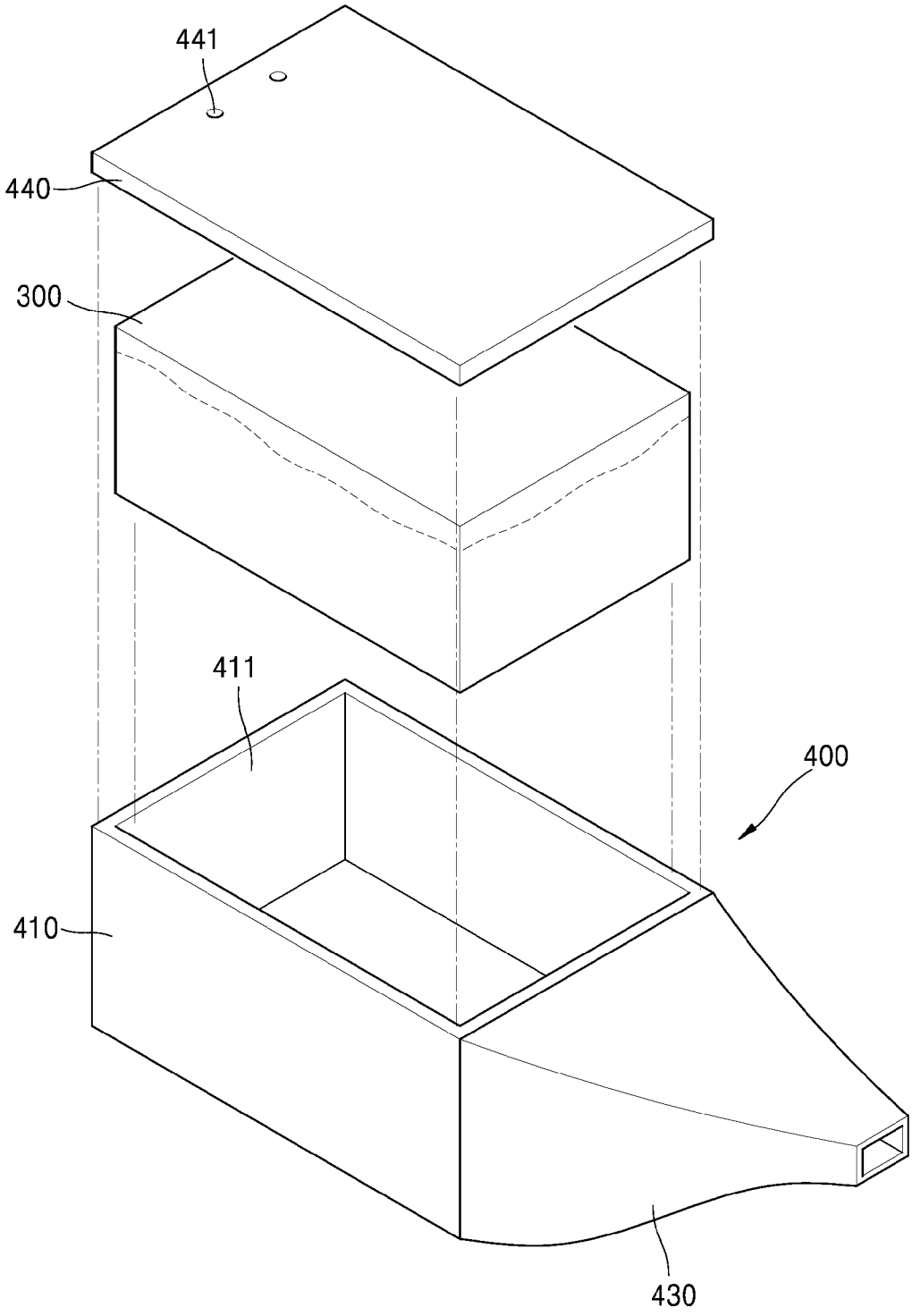

[Fig. 4]
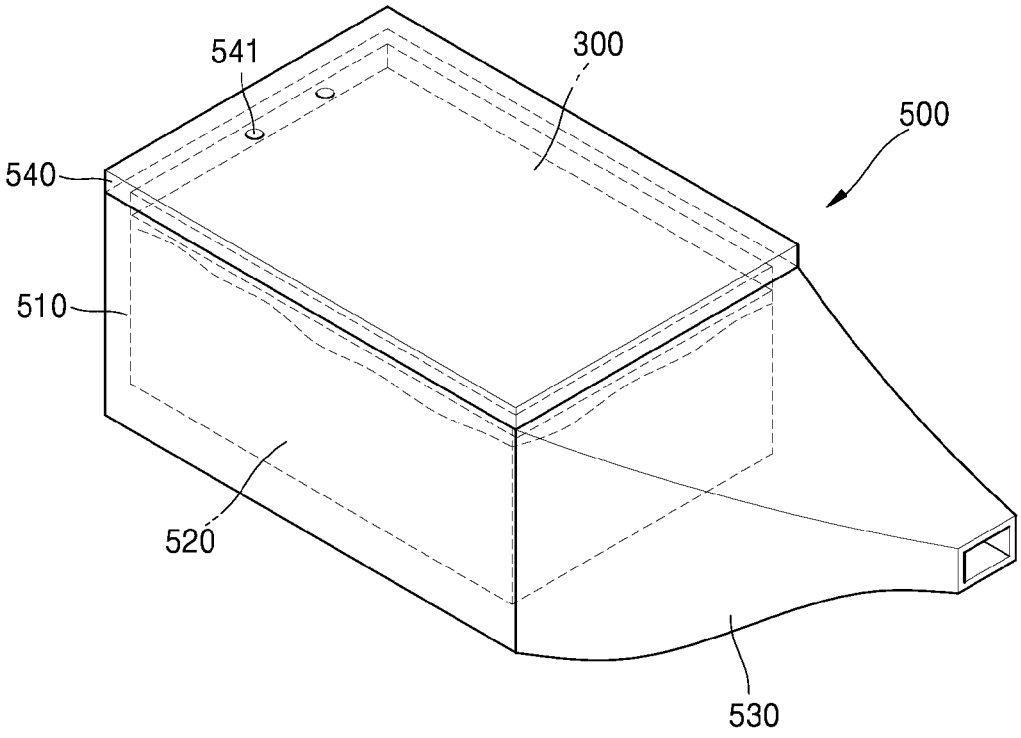

AEROSOL-GENERATING ARTICLE INCLUDING VAPORIZING SUBSTRATE AND AEROSOL-GENERATING SYSTEM USING THE SAME

CROSS REFERENCE TO RELATED APPLICATIONS

This application is a National Stage of International Application No. PCT/KR2020/013925 filed Oct. 13, 2020, claiming priority based on Korean Patent Application No. 10-2019-0127271 filed Oct. 14, 2019.

TECHNICAL FIELD

The present invention relates to an aerosol-generating article including a vaporizing agent and an aerosol-generating system using the same.

BACKGROUND ART

Recently, the demand for an alternative to traditional cigarettes has increased. For example, there is growing demand for a device that generates an aerosol by heating an aerosol generating material in an aerosol generating article (e.g., a cigarette), rather than by combusting an aerosol generating article. Accordingly, studies on a heating-type aerosol generating article and a heating-type aerosol generating device have been actively conducted.

In a conventional heating-type aerosol-generating article or device, a heating device is required to generate an aerosol, and components such as electric wiring and a battery are also required to supply power to the heater. Accordingly, conventional aerosol generating articles and aerosol generating devices have problems in terms of structural complexity and manufacturing cost.

DISCLOSURE OF INVENTION

Solution to Problem

In the case of the aerosol-generating article and the aerosol-generating system according to the embodiment, the above-described problem can be solved.

However, the technical problem is not limited to the above, and other technical problems may be inferred from the following examples.

Advantageous Effects of Invention

An aerosol-generating article and an aerosol-generating system according to an embodiment may generate an aerosol without a separate heating device. Accordingly, the structure of the aerosol-generating article and device may be simplified, and the manufacturing cost of the aerosol-generating article and device may be reduced.

The effects of the present disclosure are not limited to those described above, and may include all effects that may be inferred from the configuration described later.

BRIEF DESCRIPTION OF DRAWINGS

FIG. 1 is a diagram showing an aerosol-generating article including a vaporizing agent according to an embodiment.

FIG. 2 is a side cross-sectional view illustrating an aerosol-generating article including a vaporizing agent according to an embodiment from one side.

FIG. 3 is an exploded view of an aerosol-generating device combined with an aerosol-generating article, according to an exemplary embodiment are separated.

FIG. 4 is a diagram illustrating a combination of an aerosol-generating article device and an aerosol-generating article, according to an exemplary embodiment are combined.

BEST MODE FOR CARRYING OUT THE INVENTION

A first aspect of the present disclosure may provide an aerosol-generating article including a sealed container; and a composition contained in the sealed container and comprising a tobacco material in an amount of 40 to 70 parts by weight and a vaporizing agent in an amount of 30 to 60 parts by weight, based on 100 parts by weight of the composition, wherein the tobacco material includes an aerosol-generating material and tobacco leaves cut to a size of 10 mm or less, and the vaporizing agent is configured to generate oxidizing heat when exposed to air such that the tobacco material is heated.

In embodiments, the sealed container may include two or more vaporization chambers containing the composition and at least one intermediate chamber separating the two or more vaporization chambers from each other.

In examples, the vaporizing agent may include at least one of iron powder, cast iron powder, water atomized iron powder, electrolytic iron powder, zinc (Zn), aluminum (Al), magnesium (Mg), copper (Cu), nickel (Ni), and tin (Sn).

In examples, the vaporizing agent includes a compound represented by following Formula 1 or Formula 2:

$$C_nH_{2n+1}M^1 \quad \text{[Formula 1]}$$

$$(C_nH_{2n+1})_2M^2 \quad \text{[Formula 2]}$$

wherein n is a positive number, $M^1$ is Li or Al, and $M^2$ is Mg, Sn, Zn, or Ga.

In examples, the composition further may include at least one of water, salts, a reaction catalyst, and a flavoring.

In examples, the tobacco material may include propylene glycol in an amount from 30 to 70 parts by weight, glycerin in an amount of 30 to 70 parts by weight, and the tobacco leaves in an amount of 0.1 to 5 parts by weight.

In examples, the sealed container is filled with nitrogen ($N^2$).

A second aspect of the present disclosure may provide an aerosol-generating system including an aerosol-generating article described above; and a device including an accommodation space for accommodating the aerosol-generating article, a cover covering the accommodation space, and a mouthpiece.

In embodiments, the cover may include two or more holes through which air is introduced into the accommodation space from the outside of the device.

The means for solving the problem is not limited to the above, and may include all matters that may be inferred by a person skilled in the art throughout the present specification.

Mode for the Invention

With respect to terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, there are terms arbitrarily selected by the applicant, and in this case, the meaning of the terms will be described in detail in the description of the corresponding invention. Therefore, the terms used in the present invention should be defined based on the meaning of the term and the overall contents of the present invention, not a simple name of the term.

In addition, unless explicitly described to the contrary, the word "comprise" and variations such as "comprises" or "comprising" will be understood to imply the inclusion of stated elements but not the exclusion of any other elements.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, a "vaporizing agent" refers to a compound that causes other substances to vaporize. For example, the vaporizing agent may be a substance that generates heat by itself, and the vaporizing agent may react with oxygen in the air to generate heat of oxidation.

Throughout the specification, a "vaporization chamber" means a space in which a substance is vaporized. For example, a material contained in the vaporization chamber may be heated to change into a gas.

Hereinafter, embodiments of the present invention will be described in detail with reference to the drawings.

FIG. 1 is a diagram showing an aerosol-generating article 100 including a vaporizing agent according to an embodiment.

The aerosol-generating article 100 may include a sealed container 110 and a composition 120 contained in the sealed container 110. The composition 120 may include a tobacco material in an amount of 40 to 70 parts by weight and a vaporizing agent in an amount of 30 to 60 parts by weight, based on 100 parts by weight of the total composition. The vaporizing agent may heat a tobacco material by generating oxidizing heat when exposed to air.

Referring to FIG. 1, the sealed container 110 according to an embodiment may include a main body 111 accommodating the composition 120 and a cover 112 that seals the main body 111 by covering an open end surface of the main body 111. As illustrated in FIG. 1, the cover 112 may cover the top surface of the main body 111. For example, the sealed container 110 may be manufactured by completely covering and sealing the top surface of the main body 111 accommodating the composition 120 by the cover 112. However, it is not particularly limited thereto, and the cover 112 may cover other surface of the main body 111 which is open.

In one embodiment, the main body 111 and the cover 112 may be formed as a single body. The main body 111 and the cover 112 may be formed of a transparent, translucent, or opaque material.

In another embodiment, the main body 111 and the cover 112 may be formed separately. The cover 112 may be formed of a material different from that of the main body 111. For example, the cover 112 may be formed of a material of a transparent film or a vinyl film. However, it is not particularly limited thereto, and the main body 111 may be formed of a transparent material, and the cover 112 may be formed of an opaque or translucent material. When at least one of the main body 111 and the cover 112 is formed of a transparent material, the state of the composition 120 contained in the main body 111 may be visually confirmed from the outside.

When the main body 111 and the cover 112 are formed separately, the main body 111 and the cover 112 may be coupled to each other through a joint (not shown). The joint may be formed at, for example, edges of the main body 111 and the cover 112. Alternatively, the main body 111 and the cover 112 may be bonded to each other by an adhesive. Prior to generating an aerosol using the aerosol-generating article 100, the user may separate the cover 112 from the main body 111. When the user separates the cover 112 from the main body 111, the interior of the aerosol-generating article 100 may be exposed to external air.

In embodiments, the sealed interior of the sealed container 110 may be filled with nitrogen ($N_2$). The sealed container 110 may contain a vaporizing agent which may oxidize and generate heat when exposed to air. Therefore, while the aerosol-generating article 100 is stored, the sealed interior of the sealed container 110 may be filled with nitrogen gas such that the composition 120 is not heated by the vaporizing agent. However, it is not particularly limited thereto, and the sealed interior of the sealed container 110 may be filled with other gases having weak reactivity, such as argon (Ar).

The composition 120 may include a tobacco material and a vaporizing agent.

The tobacco material may include an aerosol-generating material and tobacco leaves.

The aerosol-generating material may include, for example, at least one of glycerin, propylene glycol, ethylene glycol, dipropylene glycol, diethylene glycol, triethylene glycol, tetraethylene glycol, and oleyl alcohol.

Tobacco leaves, for example, may be included in the form of a tobacco sheet or a strand. In addition, the tobacco leaf may be included in the form of a cut tobacco obtained by finely cutting a tobacco sheet. For example, the tobacco leaf may be in the form of a corrugated tobacco sheet, a crimped corrugated tobacco sheet, or a roll type tobacco sheet. In detail, the tobacco leaf may include one or more of tobacco stems, tobacco ribs, cut tobacco made of reconstituent tobacco sheet, and expanded tobacco, but is not particularly limited thereto. Tobacco leaves, for example, may be cut into a size of about 10 mm or less and about 8 mm or less, about 6 mm or less, about 4 mm or less, about 2 mm or less, or about 1 mm or less, and put in the interior of the sealed container 110. As the cut size of the tobacco leaf decreases, the contact area between the tobacco leaf and the air flowing into the sealed container 110 increases, and therefore a smoking feeling for the aerosol generated accordingly may be improved.

The vaporizing agent may be a compound that is oxidized by reacting with oxygen in the air, and may generate heat while being oxidized. In embodiments, the vaporizing agent may include at least one of iron powder, cast iron powder, water atomized iron powder, electrolytic iron powder, zinc (Zn), aluminum (Al), Magnesium (Mg), copper (Cu), nickel (Ni), and tin (Sn). The vaporizing agent may be contained in the composition in the form of a solid, liquid, or powder. If the vaporizing agent is in the form of a powder, the area in contact with oxygen in the air is widened, so the heat of oxidation may be more effectively generated.

In addition, the vaporizing agent may include a compound represented by Formula 1 or Formula 2 below.

$$C_nH_{2n+1}M^1 \quad \text{[Formula 1]}$$

$$(C_nH_{2n+1})_2M^2 \quad \text{[Formula 2]}$$

Here, n is a positive number, $M^1$ is Li or Al, and $M^2$ may be Mg, Sn, Zn, or Ga. In detail, the vaporizing agent may be alkyl lithium ($C_nH_{2n+1}Li$), alkyl aluminum ($C_nH_{2n+1}$ Al), dialkylmagnesium ($(C_nH_{2n+1})_2Mg$), dialkyltin ($(C_nH_{2n+1})_2Sn$), dialkylzinc ($(C_nH_{2n+1})_2$ Zn), or dialkylgallium ($(C_nH_{2n+1})_2Ga$). As a preferred example, the vaporizing agent may be methyl lithium ($CH_3Li$), ethyllithium ($C_2H_5Li$), dimethyltin ($C_2H_6Sn$), di-ethylzinc ($C_4H_{10}Zn$), dimethylgallium ($C_2H_6Ga$), or dimethylmagnesium ($C_2H_6Mg$).

As a further example, the vaporizing agent may include a silane (SixHy) compound. Here, x and y may be positive numbers. As a specific example, the vaporizing agent may include a monosilane ($SiH_4$) or disilane ($Si_2H_6$) compound.

The above-described compound may react with oxygen in air and generate heat of oxidation. When the composition is exposed to air, the composition may be heated in the range of about 50° C. to about 300° C. by the compounds described above.

The composition 120 may include a tobacco material in an amount of 40 to 70 parts by weight and a vaporizing agent in an amount of 30 to 60 parts by weight based on 100 parts by weight of the total composition. By having the weight ratio of the tobacco material and the vaporizing agent as described above, the entire composition may be preferably heated to a temperature of 200° C. to 300° C. If the vaporizing agent is less than 30 parts by weight, the temperature of the heated composition may not reach about 200° C. By contrast, if the vaporizing agent exceeds 60 parts by weight, the quality of the aerosol may be degraded due to the decreased weight of the tobacco material. It is experimentally confirmed that the heating temperature may be in the range of 200° C. to 300° C. if the composition 120 having the above-described weight ratio is exposed to air.

In embodiments, the tobacco material may include propylene glycol in an amount from about 30 to about 70 parts by weight, glycerin in an amount from about 30 to about 70 parts by weight, and tobacco leaves in an amount from about 0.1 to about 5 parts by weight, based on 100 parts by weight of the total tobacco material. However, it is not necessarily limited thereto, and the content of each tobacco material may be changed within a range that can be easily designed by those skilled in the art. However, within the above-described numerical range, a feeling of smoking may be improved.

In embodiments, the composition 120 may further include at least one of water, salts, a reaction catalyst, and flavorings.

For example, the composition 120 may contain water, solvent, ethanol, plant extract, flavoring, flavoring agents, or vitamin mixture. The flavoring may contain menthol, peppermint, spearmint oil, and various fruit flavoring ingredients, but is not limited thereto. The flavoring agents may include ingredients that may provide a variety of flavors or flavors to the user. The Vitamin mixture may be a mixture of at least one of vitamin A, vitamin B, vitamin C, and vitamin E, but are not limited thereto. In addition, the reaction catalyst may include a material that accelerates an oxidation reaction of the vaporizing agent.

In an embodiment, the composition 120 may be a homogeneous or heterogeneous mixture of an aerosol-generating material, a tobacco material, and a vaporizing agent. In addition, when the composition 120 further contains at least one of water, salts, the reaction catalyst, and the flavoring, the composition 120 may be a homogeneous or heterogeneous mixture thereof.

FIG. 2 is a cross-sectional side view of an aerosol-generating article 200 including a vaporizing agent according to another embodiment.

Referring to FIG. 2, the sealed container 210 may include two vaporization chambers 231 and 232 containing a composition 220 and at least one intermediate chamber 240 separating the two vaporization chambers 231 and 232 from each other.

The sealed container 210 may include a main body 211 and a cover 212. Since each of the main body 211 and the cover 212 may correspond to the main body 111 and the cover 112 of FIG. 1, overlapping descriptions are omitted.

The main body 211 may include a first vaporization chamber 231, a second vaporization chamber 232, and the intermediate chamber 240. The intermediate chamber 240 may be located between the first vaporization chamber 231 and the second vaporization chamber 232, and the first vaporization chamber 231 and the second vaporization chamber 232 may be separated from each other through the intermediate chamber 240. The intermediate chamber 240 may be surrounded by, for example, a porous membrane 241. The porous membrane 241 may be formed to allow air to pass freely and to prevent the composition 220 from passing.

The composition 220 may be contained in, for example, two vaporization chambers 230. A composition 221 contained in the first vaporization chamber 231 and a composition 222 contained in the second vaporization chamber 232 may be the same or different from each other. For example, the first vaporization chamber 231 may contain an aerosol-generating material, tobacco leaves, and vaporizing agents, and the second vaporization chamber 232 may further include water, flavorings, etc. in addition to the aerosol-generating material, the tobacco leaves, and the vaporizing agents. However, embodiments are not limited thereto. The composition 221 contained in the first vaporization chamber 231 and the composition 222 contained in the second vaporization chamber 232 contain the same components, but the content ratio between the components may be different.

In the embodiment shown in FIG. 2, when the cover 212 of the aerosol-generating article 200 is opened, the vaporizing agent may be exposed to air and generate heat. In this case, the aerosol generated in the first and second vaporization chambers 231, 232 may be different from each other, because the components of the composition contained in the first vaporization chamber 231 and the second vaporization chamber 232 are different from each other. The aerosols generated from the chambers may be mixed with each other by the airflow generated when the user inhales.

The cover 212 of the aerosol-generating article 200 may be separated from the main body 211 by an external force. For example, the cover 212 may be separated from the main body 211 by a user's hand. The composition 220 may be exposed to oxygen in the air. The intermediate chamber 240 increases the contact surface area between the composition 220 and air, so that the vaporizing agent contained in the composition 220 may help to generate more heat of oxidation.

However, the aerosol-generating article 200 shown in FIG. 2 is only an example, and the positions and numbers of the vaporization chamber and the intermediate chamber may be changed according to embodiments.

FIG. 3 is an exploded view of a device 400 combined with an aerosol-generating article 300, according to an exemplary embodiment.

Referring to FIG. 3, the aerosol-generating article 300 is illustrated in a rectangular parallelepiped shape, but is not particularly limited thereto. For example, the shape of the aerosol-generating article 300 may be a cube or may include a curved area, and an accommodation space 411 of the device may be formed in the corresponding shape. Preferably, the cover (not shown) of the aerosol-generating article 300 may be separated from the body, and the aerosol-generating article 300 may be disposed in the accommodation space 411 of the device 400.

The device 400 may include a device body 410, the accommodation space 411, a mouthpiece 430, and a cover 440.

The aerosol-generating article 300 may be arranged in the accommodation space 411 of the device 400. As described above, the shape of the aerosol-generating article 300 may be various, and the accommodation space 411 of the device 400 may be formed in a corresponding shape to accommodate the aerosol-generating article 300.

In an embodiment, the device 400 may further include a porous membrane (not shown). The porous membrane may inhibit the tobacco materials or vaporizers from moving to the mouthpiece 430. Therefore, when a user inhales an aerosol through the mouthpiece 430, the tobacco material or vaporizing agent may be blocked by the porous membrane, and the aerosol generated by the vaporizing agent may be only moved from the aerosol-generating article 300 to the mouthpiece 430. Accordingly, the user may inhale the aerosol without using a separate heating device.

As shown in FIG. 3, neither the aerosol-generating article 300 nor the device 400 separately includes an electrical heating device. Thus, there is no need to supply power to the aerosol-generating article 300 or the device 400. When the vaporizing agent in the composition included in the aerosol-generating article 300 is exposed to air, the vaporizing agent naturally generates heat and transmits heat to the aerosol-generating material, thereby generating an aerosol. Accordingly, the structure of the aerosol-generating article 300 and the device 400 may be simplified, and the manufacturing cost of the aerosol-generating article 300 and the device 400 may be reduced.

The cover 440 may cover the accommodation space 411 of the device 400. In an embodiment, the cover 440 may include two or more holes 441 through which air is introduced into the accommodation space 411 from the outside of the device 400.

FIG. 4 is a diagram illustrating a combination of a device 500 and an aerosol-generating article 300 including a vaporizing agent, according to an exemplary embodiment.

As shown in FIG. 4, a system for generating an aerosol may include an aerosol-generating article 300 and a device 500 including an accommodation space for accommodating the aerosol-generating article 300, a cover 540 covering an accommodation space, and a mouthpiece 530.

Referring to FIG. 4, the aerosol-generating article 300 may be preferably coupled to the device 500. At least a portion of the sealed container (i.e., the aerosol-generating article 300) may be opened before the aerosol-generating article 300 is combined with the device 500, for example, by a user removing the cover (not shown) of the aerosol-generating article 300. However, it is not particularly limited thereto, and a user may put the aerosol-generating article 300 in the accommodation space of the device 500 without removing a cover of the aerosol-generating article 300. In this case, a portion of the aerosol-generating article 300 may be opened in the course of combining the cover 540 with the device body 510.

After the aerosol-generating article 300 is completely combined with the device 500, air may be introduced into the aerosol-generating article 300 from the outside of the device 400 through a hole 541 formed in the cover 540.

The vaporizing agent of the composition 520 contained in the aerosol-generating article 300 may react with the introduced air. In particular, the vaporizing agent may cause an oxidation reaction with oxygen ($O_2$) in the introduced air, thereby generating heat of oxidation. The generated heat of oxidation may heat the composition 520 and the tobacco material or aerosol-generating material contained in the composition 520. Accordingly, an aerosol may be generated from the composition 520. When a user puts his or her mouth on the mouthpiece 530 to form a negative pressure, the aerosol generated from the composition 520 may be moved toward the mouthpiece 530. Accordingly, the user may inhale the generated aerosol through the mouthpiece 530.

In one embodiment, when the aerosol-generating article 300 is covered by the cover 540 of the device 500, at least a portion of the sealed container is opened, and the composition may be exposed to air. Although not shown in FIG. 4, the cover 540 may further include a protrusion formed on its surface facing the device body 510, for example, a spike. The protrusion may break and open a portion of the aerosol-generating article 300 when the cover 540 and the device body 510 are coupled. For example, the protrusion may be opened by breaking the cover (not shown) of the aerosol-generating article 300, but is not particularly limited thereto.

In an embodiment, air may be introduced into the aerosol-generating article 300 from the outside through the open portion of the aerosol-generating article 300. When air is introduced, the vaporizing agent in the composition naturally begins to generate heat and may heat the tobacco material. Accordingly, an aerosol may be generated. According to the aerosol-generating system described above, an aerosol can be effectively generated without an additional power source or heating device in the aerosol-generating article and the aerosol-generating device. Accordingly, resources required for manufacturing the aerosol-generating article and the aerosol-generating device may be reduced, and the manufacturing process may be simplified, thereby reducing the manufacturing cost of the aerosol-generating article and the aerosol-generating device.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol-generating article comprising:

a sealed container; and a composition contained in the sealed container and comprising a tobacco material in an amount of 40 to 70 parts by weight and a vaporizing agent in an amount of 30 to 60 parts by weight, based on 100 parts by weight of the composition, wherein the tobacco material includes an aerosol-generating material and tobacco leaves cut to a size of 10 mm or less, and the vaporizing agent is configured to generate oxidizing heat by reacting with oxygen in the air when exposed to air such that the tobacco material is heated.

2. The aerosol-generating article of claim 1, wherein the sealed container comprises two or more vaporization chambers containing the composition and at least one intermediate chamber separating the two or more vaporization chambers from each other.

3. The aerosol-generating article of claim 1, wherein the vaporizing agent includes at least one of iron powder, cast iron powder, water atomized iron powder, electrolytic iron powder, zinc (Zn), aluminum (Al), magnesium (Mg), copper (Cu), nickel (Ni), and tin (Sn).

4. The aerosol-generating article of claim 1, wherein the vaporizing agent includes a compound represented by following Formula 1 or Formula 2:

$$C_nH_{2n+1}M^1 \quad \text{[Formula 1]}$$

$$(C_nH_{2n+1})_2M^2 \quad \text{[Formula 2]}$$

wherein n is a positive number, $M^1$ is Li or Al, and $M^2$ is Mg, Sn, Zn, or Ga.

5. The aerosol-generating article of claim 1, wherein the composition further comprises at least one of water, salts, a reaction catalyst, and a flavoring.

6. The aerosol-generating article of claim 1, wherein the tobacco material comprises propylene glycol in an amount of 30 to 70 parts by weight, glycerin in an amount of 30 to 70 parts by weight, and the tobacco leaves in an amount of 0.1 to 5 parts by weight.

7. The aerosol-generating article of claim 1, wherein the sealed container is filled with nitrogen ($N_2$).

8. An aerosol-generating system comprising:

the aerosol-generating article according to claim 1; and a device including an accommodation space configured to accommodate the aerosol-generating article, a cover configured to cover the accommodation space, and a mouthpiece.

9. The aerosol-generating system of claim 8, wherein the cover includes two or more holes through which air is introduced into the accommodation space from outside of the device.

* * * * *